US008336642B2

(12) United States Patent
Lavrut et al.

(10) Patent No.: US 8,336,642 B2
(45) Date of Patent: Dec. 25, 2012

(54) DRILLING SYSTEM

(75) Inventors: Eric Lavrut, Yokohama (JP); Pierre-Jérôme Acquaviva, Toulon (FR); Henri Denoix, Chatenay Malabry (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 258 days.

(21) Appl. No.: 11/997,416

(22) PCT Filed: Jul. 14, 2006

(86) PCT No.: PCT/EP2006/006955

§ 371 (c)(1), (2), (4) Date: Aug. 13, 2008

(87) PCT Pub. No.: WO2007/017046

PCT Pub. Date: Feb. 15, 2007

(65) Prior Publication Data

US 2009/0008150 A1 Jan. 8, 2009

(30) Foreign Application Priority Data

Aug. 8, 2005 (EP) ..... 05291698

(51) Int. Cl.
*E21B 44/00* (2006.01)

(52) U.S. Cl. ..... 175/26; 175/57; 175/97

(58) Field of Classification Search ..... 175/26, 175/57, 97

See application file for complete search history.

(56) References Cited

U.S. PATENT DOCUMENTS

| | | | | |
|---|---|---|---|---|
| 4,354,233 | A | 10/1982 | Zhukovsly | |
| 4,854,397 | A | 8/1989 | Warren et al. | |
| 5,394,951 | A * | 3/1995 | Pringle et al. | 175/61 |
| 5,449,047 | A | 9/1995 | Schivley, Jr. | |
| 6,029,754 | A * | 2/2000 | Kattentidt et al. | 175/27 |
| 6,230,813 | B1 * | 5/2001 | Moore et al. | 166/381 |
| 6,419,031 | B1 * | 7/2002 | Poysti | 175/24 |
| 6,467,557 | B1 | 10/2002 | Krueger et al. | |
| 6,516,898 | B1 | 2/2003 | Krueger | |
| 2001/0050186 | A1 | 12/2001 | Wilson et al. | |
| 2007/0068704 | A1 * | 3/2007 | Krueger et al. | 175/57 |
| 2009/0008150 | A1 * | 1/2009 | Lavrut et al. | 175/45 |
| 2010/0314173 | A1 * | 12/2010 | Hbaieb et al. | 175/57 |

FOREIGN PATENT DOCUMENTS

| | | |
|---|---|---|
| EP | 0911483 | 4/1999 |
| WO | WO2004083595 | 9/2004 |

* cited by examiner

*Primary Examiner* — Jennifer H Gay

(74) *Attorney, Agent, or Firm* — Stephanie Chi; Darla Fonseca; Brigitte Jeffery Echols

(57) ABSTRACT

A drilling system for drilling a borehole in an underground formation, comprises a rotary drill bit, a drilling drive mechanism that is capable of applying both rotating the drill bit and applying an axial force to the drill bit, and a control system that is capable of controlling the drive mechanism so as to control rotation of the drill bit and the axial force applied to the drill bit in order to control the depth of cut created by the drill bit when drilling through the formation. A method of drilling a borehole in an underground formation with a rotary drill bit, comprises applying rotation and an axial force to the drill bit and controlling the rotation and axial force so as to control the depth of cut created by the drill bit when drilling through the formation.

8 Claims, 2 Drawing Sheets

DRILLING SYSTEM

TECHNICAL FIELD

This invention relates to a drilling system and method that is particularly applicable to drilling with flexible conveyance systems such as wireline and coiled tubing.

BACKGROUND ART

Drilling using coiled tubing as a drill string was first implemented several years ago and hundreds of wells are now drilled every year with this technology. A review of the use of re-entry drilling using coiled tubing can be found in HILL, D, et al. Reentry Drilling Gives New Life to Aging Fields. *Oilfield Review*. Autumn 1996, p. 4-14. Coiled tubing drilling (CTO) shows many advantages compared to conventional drilling with jointed pipes, including:

- The ability to operate in pressurized wells;
- Fast tripping speeds;
- The ability to circulate continuously while tripping and drilling;
- The ability to be used in slim hole and through-tubing; and
- Rig-less operation.

However, despite significant development over the years, CTD has remained a niche application, with primary markets limited to thru-tubing re-entries wells, under balanced and slim hole drilling. This limited expansion is due to certain inherent disadvantages of CTD:

- A relatively large tubing size is needed for drilling applications and only a small portion of the current global CT rig fleet is capable of handling such sizes;
- The size and the weight of a typical spool of coiled tubing is sometimes too great for the hosting capacity of platforms on which it is used;
- CTD requires surface-pumping equipment that is comparable in size to that used in conventional drilling; and
- CTD can only have a limited reach in horizontal wells.

These problems arise, in part, from the fact that the basic drilling process is the same as that used in a conventional, rig-based drilling system. This means that the drilling process produces cuttings of a size and volume that still require powerful (and therefore large) surface pumping units, and large diameter coiled tubing to handle the cuttings in the borehole.

Recent proposals for the use of downhole drilling systems for use with wireline drilling operations have resulted in the development of downhole control of the drilling process. This has been required to accommodate the use of downhole electric motors for drilling and the fact that the conveyance system (wireline cable) cannot provide any weight on bit or torque reaction. Such systems typically use downhole tractors to move drilling tools through the well and provide weight on bit for the drilling process. A number of tractors are known for use in a borehole environment, such as those described in U.S. Pat. Nos. 5,794,703; 5,954,131; 6,003,606; 6,179,055; 6,230,813; 6,142,235; 6,629,570; GB 2 388 132; WO 2004 072437; U.S. Pat. Nos. 6,629,568; and 6,651,747.

This invention aims to address some or all of the problems encountered with the prior art systems.

DISCLOSURE OF THE INVENTION

One aspect of the invention comprises a drilling system for drilling a borehole in an underground formation, comprising a rotary drill bit, a drilling drive mechanism that is capable of applying both rotating the drill bit and applying an axial force to the drill bit, and a control system that is capable of controlling the drive mechanism so as to control rotation of the drill bit and the axial force applied to the drill bit in order to control the depth of cut created by the drill bit when drilling through the formation.

Another aspect of the invention comprises a method of drilling a borehole in an underground formation with a rotary drill bit, comprising applying rotation and an axial force to the drill bit and controlling the rotation and axial force so as to control the depth of cut created by the drill bit when drilling through the formation.

This invention differs from previously proposed techniques in that depth-of-cut (DOC) is used as a controlling/controlled parameter rather than a mere product of the drilling action as in other techniques.

A flexible conveyance system, such as a wireline or coiled tubing, can be provided, extending from the drilling drive mechanism along the borehole to the surface.

The drilling drive mechanism can comprise an anchoring mechanism, operable to anchor the drive system in the borehole to provide a reaction to the rotation and axial force applied to the drill bit. The drilling drive mechanism can comprise a rotary drive portion, the control system being capable of controlling the torque applied to the bit and the rate of rotation of the bit in order to control the depth of cut; and an axially-extendable drive portion, the control system being able to measure and control extension of the axially-extendable drive portion in order to control the depth of cut.

It is particularly preferred to control the rate of penetration of the drill bit into the formation as part of the control of depth of cut.

Electric or hydraulic motors can be used in the drilling drive mechanism,

The means of providing electric power can include a cable, in the case of coiled tubing as the conveyance system, running inside the coiled tubing, a cable clamped to the coiled tubing at regular intervals, or the use of the wires of an electric coiled tubing Where the downhole drilling system is hydraulically powered and it can use a downhole alternator to convert hydraulic energy to electric energy needed by the tools.

The drilling drive mechanism and the control system are preferably included in a downhole unit that can be connected to the conveyance system. The downhole unit can be moved through the borehole using the flexible conveyance system which is then isolated from torque and axial force generated when drilling through the formation, by the use of the anchoring mechanism described above, for example.

BRIEF DESCRIPTION OF THE DRAWINGS

The present invention is described below in relation to the accompanying drawings, in which.

MODE(S) FOR CARRYING OUT THE INVENTION

The invention is based on control of the drilling process by controlling the penetration per bit revolution (Depth of Cut control). Because the depth of cut reflects the size of the cuttings produced, such control can be used to create relatively small cuttings at all times (smaller than in conventional drilling), whose transport over a long distance requires much less power.

In conventional drilling systems (including previous CTD systems), the actual drilling operation is performed by applying controlled weight to the drill bit (WOB) that is rotated from surface or with a drilling motor to provide RPM to the bit, resulting in penetration into the formation (ROP). The torque and RPM encountered at the drill bit (TOB) is a product of the resistance of the formation and the torsional stiffness of the drill string to the rotary drilling action of the drill bit. In effect, the actively (but indirectly) controlled parameters are WOB and RPM. TOB and ROP are products of this control.

The drilling system according to the invention does not take the same approach. It is possible to control the length drilled per bit revolution (also called "depth of cut" or DOC), for example by measuring, at each instant, the penetration into the formation (ROP) and the bit rotation speed (RPM). The weight on bit (WOB) in this case is only the reaction of the formation to the drilling process.

A drilling system according to an embodiment of the invention comprises the following elements:

- A drilling motor capable of delivering the torque on bit (JOB) and the actual bit RPM with a predetermined level of accuracy and control.
- A tractor device capable of pushing the bit forward with a predetermined accuracy in instantaneous rate of penetration (ROP). The tractor can also help pulling or pushing the coiled tubing downhole.
- Electronics and sensors to allow control of the drilling parameters (TOB, DOC, RPM, ROP,).
- Surface or downhole software for optimizing the drilling process and especially the depth of act.

Figure 1:
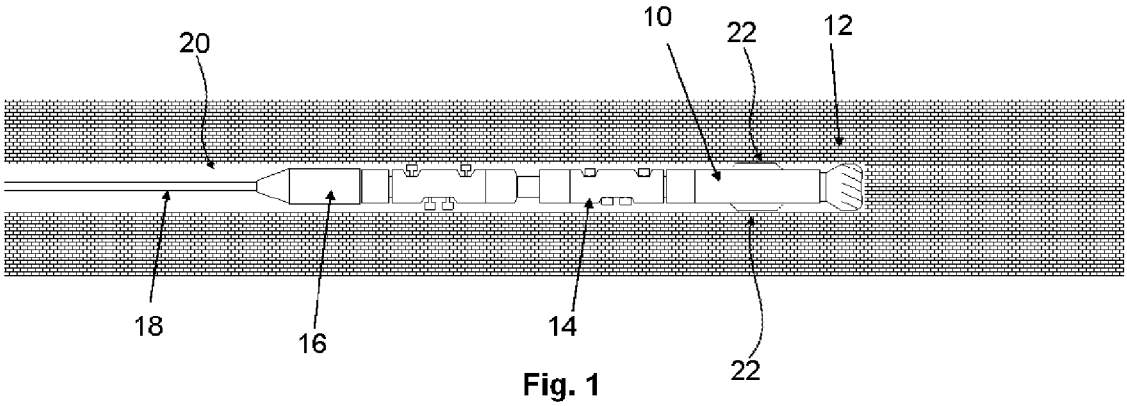
FIG. 1 shows a drilling system according to an embodiment of the invention.

A drilling system according to an embodiment of the invention for drilling boreholes in underground formations is shown in FIG. 1. The system includes a downhole drilling unit comprising a rotary drive system 10 carrying a drill bit 12. An axial drive system 14 is positioned behind the rotary drive system 10 and connected to the surface a control section 16 and coiled tubing 18 carrying an electric cable (not shown).

The rotary drive system 10 includes an electric motor but which the drill bit 12 is rotated. The power of the motor will depend on its size although for most applications, it is likely to be no more than 3 kW.

In use, the drilling system is run into the borehole 20 until the bit 12 is at the bottom. Drilling proceeds by rotation of the bit 12 using the rotary drive system 10 and advancing the bit into the formation by use of the axial drive system 16. Control of both is effected by the control system 16 which can in turn be controlled from the surface or can run effectively independently.

By generating axial effort downhole by use of the tractor 14, and by generating relatively small cuttings, the size of the coiled tubing 18 used can be smaller than with previous CTD systems. Because the coiled tubing is not required to generate weight on bit, the basic functions to be performed by the coiled tubing string are limited to:

- Acting as a flowline to convey the drilling fluid downhole;
- Acting as a retrieval line to get the bottom hole assembly out of hole, especially when stuck; and
- Helping to run in hole with its pushing capacity.

Currently, most CTD lateral drilling is performed with 2-in (51 mm) to 2⅞ in (73 mm) coiled tubing (tubing OD); which is considered to provide a good trade-off between performance and cost. The system according to the invention allows drilling of hole sizes comparable to those of known CTD systems to be undertaken with a coiled tubing of less than 1½ in (38 mm) OD.

The drilling system generates all drilling effort downhole and therefore eliminates the need to transfer drilling forces, such as weight-on-bit, from surface via the coiled tubing to the bit 12. The system also controls the drilling process so as to generate small drill cuttings which reduces the hydraulics requirements for cuttings transport back to the surface.

Beside the benefit of the size of the coiled tubing itself (smaller spool size and weight, ease of handling, etc.), other benefits arise from this approach, including:

- Smaller surface equipment (injector, stripper, mud pumps . . . );
- Ability to perform very short radius drilling;
- Longer extended reach; and
- Increase of tubing life-cycle.

The axial drive system is preferably a push-pull tractor system such as is described in PCT/EP04/01167.

The tractor 14 has a number of features that allow it to operate in a drilling environment, including:

- The ability to function in a flow of cuttings-laden drilling fluid and to be constructed so that cuttings do not unduly interfere with operation;
- The ability to operate in open hole;
- Accurate control of ROP with precise control of position and speed of the displacement.
- Accurate measurement of weight on bit
- The presence of a flow conduit for drilling fluid circulation in use.

Certain features can be optimised for efficient tripping, such as a fast tractoring speed (speed of moving the downhole unit through the well), and the capabilities of crawling inside casing or tubing. In order for the tractor to be useful for re-entry drilling, it needs the ability to cross a window in the casing and to be compatible with a whipstock.

In one preferred embodiment, the tractor uses the push-pull principle. This allows dissociation of coiled tubing pulling and drilling, which helps accurate control of the weight on bit. A suitable form of tractor is described in European patent application no. 04292251.8 and PCT/EP04/01167.

In another embodiment, the tractor is a continuous system, with wheels or chains or any other driving mechanism.

The use of a tractor 14 also allows a shorter build-up radius and a longer lateral when compared to conventional CTO in which the coiled tubing is under tension when drilling with a tractor; thus avoiding buckling problems and giving essentially no limit on the length of the horizontal or deviated well.

In the embodiment of FIG. 1, the drilling unit is electrically powered. Drilling RPM (and torque) is generated through conversion of electric energy. Therefore, the drilling unit does not rely on the flow of drilling fluid through the coiled tubing to a drilling motor to generate RPM (as is the case in conventional drilling techniques). Hence, the coiled tubing hydraulics are only needed to transport the cuttings.

The motor 10 is provided with power by means of an electric cable which also provides a medium for a two-way high-speed telemetry between surface and downhole systems, thus enabling a better control of downhole parameters. Intelligent monitoring of downhole parameters, such as instantaneous torque on bit, can help avoid or minimize conventional drilling problems such as stick-slip motion, bit balling, bit whirling, bit bouncing, etc.

An electric cable can be deployed along with the coiled tubing. This can be achieved in various configurations, including:

the electric cable is pumped inside coiled tubing;

the electric cable is clamped on the outside of the coiled tubing, or the coiled tubing is constructed with electric wires in its structure.

However, in a different embodiment, the downhole drilling assembly can be hydraulically powered. The downhole drilling system can be hydraulically powered and equipped with a downhole alternator to provide electric power to tool components. In this configuration, there is no need for electric lines from the surface.

The control system 16 provides power and control the axial and rotary drive systems 10, 14. It comprises sensors to measure key drilling parameters (such as instantaneous penetration rate, torque on bit, bit RPM, etc.) and can be split in several modules.

Figure 2:
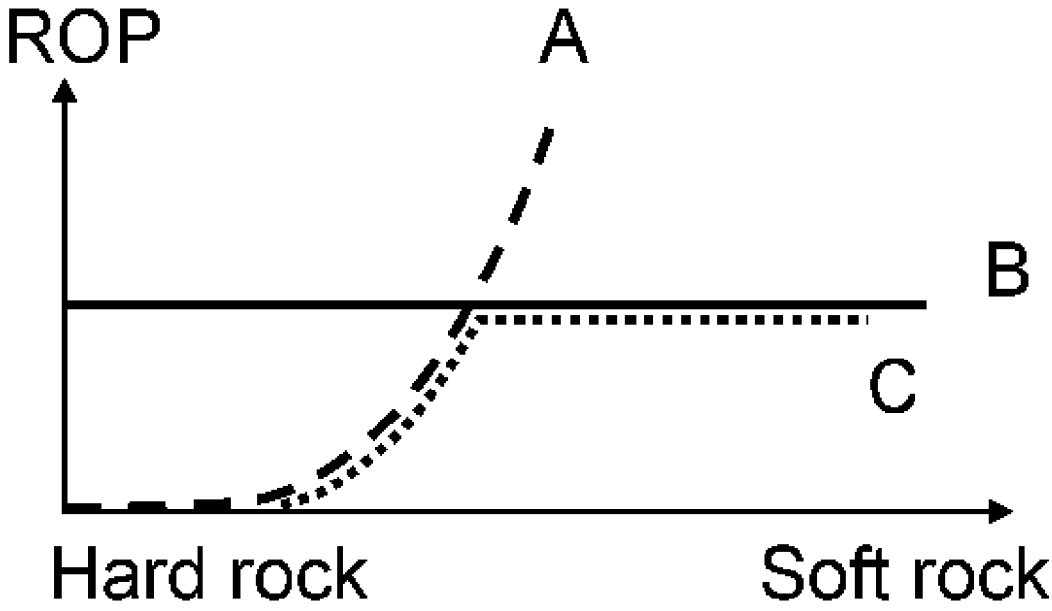
FIG. 2 is a plot of Rate of Penetration vs rock hardness.

FIG. 2 shows a plot of ROP vs rock hardness (hard at the left, soft at the right). Line A shows the increase in ROP as rock becomes softer assuming a maximum drilling power of 3 kW. As a general rule, the greater the ROP, the greater the size of cuttings. Therefore, by controlling the ROP, the size of cuttings can be controlled. Imposing a size limit to the cuttings produced, for example 200 μm (Line B) means that above a certain power, ROP must be reduced if the cuttings size is not to exceed the limit. This could be achieved by direct control of ROP which is possible with a tractortype axial drive, and/or by controlling the power to limit the ROP. In an electric drive, controlling the RPM may be a particularly convenient way to control power at the bit. Other drilling parameters can also be optimised to achieve the required cutting size limit, by the physical setup of the drilling system or by operational control. Thus the system is controlled to optimize ROP at all time while still staying within the cuttings size limit imposed (Line C).

The drilling system can include an anchoring mechanism 22, operable to anchor the drilling system in the borehole. As an illustrative example, the anchoring mechanism 22 is shown in FIG. 1 to be affixed to the rotary drive system 10. It should be understood that the anchoring mechanism 22 can also be affixed to other suitable locations, e.g., the axial drive system 14.

The control software is configured to control the drilling process to generate small cuttings. Such control can be performed in several ways including, for example, from a surface unit, in real time, through use of a telemetry system. In an alternative embodiment, the system can be autonomous (especially when there are no electric lines to surface). In this case, the downhole drilling system can include embedded software to control the progress of drilling operations. In a still further embodiment, the downhole drilling system can be configured to accept hydraulic commands from surface (downlink).

Figure 3:
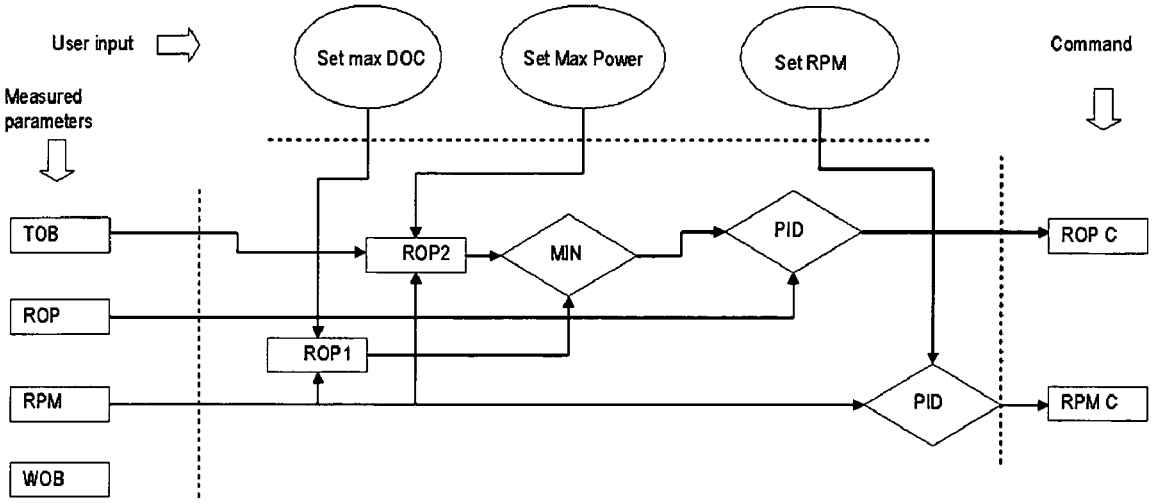
FIG. 3 is a diagram of the control system used in the drilling system of FIG. 1.

FIG. 3 shows the functional structure of one embodiment of a control system. The drilling system shown in Figure has various drilling parameters that are measured during operation. These include TOB. ROP, RPM and WOB. There are also controlled parameters including DOG (also considered as cuttings size and/or ROP, maximum set by user depending on cuttings transport environment, drilling fluid type, etc.), power (set by user depending on temperature environment rock type, hardware limitations, etc.) and RPM (set by user dependent on environment, vibrations, etch). The outputs of the control system are commands controlling POP and RPM.

In use, the operator sets max DOC, max power and RPM and drilling commences. During drilling, measurements are made of the drilling parameters listed above. A first calculated value ROP1 is obtained from the measured RPM and the set DOC. A second calculated values ROP2 is obtained from the measured RPM, TOB and the set max power. The lower of ROP1 and ROP2 is selected and PID processed with regard to the measured ROP to provide a command signal ROP C that is used to control ROP of the drilling system.

The measured and set RPM are PID processed to provide a command signal RPM C that is used to control the RPM of the system.

WOB is measured but not used in any of the control processes or actively controlled. In the context of this invention, WOB is a product of the drilling process rather than one of the main controlling parameters.

An example of a typical conventional CTD job might comprise use of a 2⅜-in coiled tubing to drill a 3¾-in (95 mm) lateral hole. A system according to the invention can allow a similar hole to be drilled with a coiled tubing less than 1½ in, while ensuring essentially the same functions as is discussed below.

A typical conventional CTD job requires about 80-gpm (360 litres per minute) of mud flow to ensure proper cuttings transport. As detailed in table 1 below, this drilling fluid flow rate corresponds to a drilling fluid velocity of 1.2-m/s in the wellbore annulus, which is considered to be a general criterion for efficient transport of drill cuttings in conventional drilling.

When drilling with a drilling system according to the invention and using a 1½ in coiled tubing with 50-gpm (225 litres per minute) flow rate, the drilling fluid mean velocity is only 0.5-m/s in the well annulus, but this will be sufficient for effective transport of the small cuttings generated.

As shown in table 2 below, the mechanical properties (load capacity and torsional strength) of the small coiled tubing are lower than in conventional CTD but this is not a limitation since the tractor handles most mechanical forces (torque and weight on bit).

As is shown in table 3, the weight of the drum is 2.6 times lower with the using the smaller coiled tubing available in the present invention.

TABLE 1

| | Conventional CTD | Invention |
|---|---|---|
| Hole size | 3¾-in (95 mm) | 3¾-in (95 mm) |
| Coiled tubing OD | 2⅜-in (60 mm) | 1½-in (38 mm) |
| Coiled tubing ID | 1.995-in (51 mm) | 1.282-in (33 mm) |
| Drilling fluid flow rate | 80-gpm (360 lpm) | 50-gpm (225 lpm) |
| Fluid velocity in hole annulus | 1.2-m/s | 0.5-m/s |

TABLE 2

| | Conventional CTD | Invention |
|---|---|---|
| Coiled tubing OD | 2⅜-in (60 mm) | 1½-in (38 mm) |
| Coiled tubing ID | 1.995-in (51 mm) | 1.282-in (33 mm) |
| Working pressure | 8,640-psi (605 kg/cm$^2$) | 7,920-psi (554 kg/cm$^2$) |
| Load capacity | 104,300-lbs (47,248 kg) | 38,100-lbs (17,214 kg) |
| Torsional strength | 5,084-ft. lbs | 1,190-ft. lbs |
| Yield radius of curvature | 509-in (12.9 m) | 321-in (252.8 m) |
| Typical guide arch radius | 105-in (2.67 m) | 60-in (1.52 m) |

TABLE 3

| | Conventional CTD | Invention |
|---|---|---|
| Coiled tubing OD | 2⅜-in (60 mm) | 1½-in (38 mm) |
| Coiled tubing ID | 1.995-in (51 mm) | 1.282-in (33 mm) |
| Drum width | 87-in | 70-in |
| Drum external diameter | 180-in | 135-in |
| Drum core diameter | 115-in | 95-in |
| Drum capacity | 17,500-ft | 17,400-ft |
| Drum total weight (with coil) | 86,500-lbs | 33,500-lbs |

The particular examples given in tables 1, 2 and 3 are illustrative of the general benefit that can be obtained using a drilling system according to the invention to obtain a similar performance to conventional systems. Changes can be made while staying within the scope of the invention. For example, the coiled tubing can be replaced by a wireline cable. In this case a different arrangement for cuttings transport may be required.

The invention claimed is:

1. A drilling system for drilling a borehole in an underground formation comprising a downhole unit comprising:

a rotary drill bit;

a drilling drive mechanism; and a control mechanism, the drive mechanism is operably coupled to the rotary drill bit to rotate the drill bit and to apply an axial force to the drill bit, and the control mechanism is operably coupled to the drive mechanism to maintain a depth of cut not to exceed a desired limit, wherein the desired limit corresponds to cuttings having a size of about 200 microns or less.

2. The drilling system according to claim 1, wherein the tubing has an outside diameter of about 1½ inches or less.

3. The drilling system according to claim 1, wherein the control mechanism processes Torque on Bit as an input for setting the command for Rate of Penetration.

4. The drilling system according to claim 1, wherein the control mechanism processes Rotations per Minute as an input for setting the command for Rate of Penetration.

5. A drilling system for drilling a borehole in an underground formation comprising a downhole unit comprising:

a rotary drill bit;

a drilling drive mechanism;

a tubing connected to the downhole unit, wherein the tubing has an outside diameter of less than 3¼ inches; and a control mechanism, the drive mechanism is operably coupled to the rotary drill bit to rotate the drill bit and to apply an axial force to the drill bit, and the control mechanism is operably coupled to the drive mechanism to maintain a depth of cut not to exceed a desired limit.

6. A method of drilling a borehole in an underground formation with a rotary drill bit, comprising: anchoring a drilling system comprising a downhole unit in the borehole, said downhole unit comprising a tubing having an outer diameter of about 3¾ inches or less, a drilling drive mechanism and a control mechanism; measuring Torque on Bit, and using the control mechanism to maintain a depth of cut not to exceed a desired limit using Torque on Bit as an input for setting a command for controlling Rate of Penetration and maintaining Depth of Cut.

7. The method of claim 6, wherein the desired limit corresponds to cuttings having a size of about 200 microns or less.

8. The method of claim 6, wherein the tubing has an outer diameter of about 1½ inches or less.

* * * * *